US005243957A

United States Patent [19]

Neilson

[11] Patent Number: 5,243,957

[45] Date of Patent: Sep. 14, 1993

[54] ARCHERY APPARATUS

[75] Inventor: Gale W. Neilson, San Marcos, Calif.

[73] Assignee: Savage Systems, Inc., San Clemente, Calif.

[21] Appl. No.: 795,032

[22] Filed: Nov. 20, 1991

[51] Int. Cl.[5] ..... F41B 5/00

[52] U.S. Cl. ..... 124/88; 124/44.5; 124/35.2; 124/32; 124/31; 124/25.6

[58] Field of Search ..... 124/23.1, 24.1, 25.6, 124/31, 32, 34, 35.1, 35.2, 44.5, 86, 88

[56] References Cited

U.S. PATENT DOCUMENTS

| | | | |
|---|---|---|---|
| 2,488,597 | 11/1949 | Konold | 124/35.2 |
| 2,819,707 | 1/1958 | Kayfes et al. | 124/35.2 |
| 3,504,659 | 4/1970 | Babington | 124/44.5 |
| 4,105,011 | 8/1978 | Chism | 124/35.2 |
| 4,308,851 | 1/1982 | Kaine, Jr. et al. | 124/35.2 |
| 4,343,286 | 8/1982 | Thacker | 124/88 X |
| 4,344,409 | 8/1982 | Barner | 124/24.1 |
| 4,674,469 | 6/1987 | Peck | 124/32 X |
| 4,787,361 | 11/1988 | Vyprachticky | 124/24.1 X |
| 4,926,835 | 5/1990 | Peck | 124/35.2 |
| 4,957,093 | 9/1990 | Hamlett | 124/23.1 X |
| 5,070,854 | 12/1991 | Peck | 124/35.2 |
| 5,078,116 | 1/1992 | Peck | 124/35.2 |

*Primary Examiner*—Randolph A. Reese
*Assistant Examiner*—Anthony Knight
*Attorney, Agent, or Firm*—Harold L. Jackson

[57] ABSTRACT

A two handed bow and a bowstring release mechanism for launching an arrow along a shooting axis includes a riser, a pair of flexible limbs mounted on the riser and a bowstring connected between the free ends of the limbs. A pair of handgrips are pivotally mounted on the riser. The bowstring release mechanism is carried by a harness adapted to be worn by the archer and includes a body member having an elongated bowstring opening for receiving the bowstring and a pair of retaining arms pivotally mounted on the body member to selectively close and open the bowstring opening. A cam and electrically operated plunger operate the retaining arms to selectively close and open the bowstring opening. A retractable arrow rest is mounted on the riser and includes a shaft engaging surface for positioning the arrow along the shooting axis when the bowstring is in its full draw position. The arrow rest is retracted away from the shooting axis by an electrically actuated mechanism such as a solenoid in response to the movement of the bowstring or to a signal delayed from the time that the bowstring is released.

41 Claims, 8 Drawing Sheets

ARCHERY APPARATUS

BACKGROUND OF THE INVENTION

1. Field of the Invention

The present invention relates to archery equipment and more particularly to an improved two handed bow, bowstring release mechanism and retractable arrow rest.

2. Description of the Prior Art

A two handed bow and a bowstring release mechanism carried by a harness adapted to be worn by the archer has been described in pending U.S. application Ser. No. 705,299, filed Apr. 24, 1991 by Huey Savage. That application has been assigned to the assignee of this application.

The '299 application particularly describes a compound bow having fixed hand grips extending outwardly from the central section of the bow and adapted to be held by both hands of an archer. A harness, arranged to be strapped to the archers back, positions a bowstring release mechanism near the archer s chin. The bowstring release mechanism is remotely controlled via a switch located near one of the handgrips.

A retractable arrow rest is mounted on the '299 bow which together with the nocking point on the bowstring align the arrow on a shooting axis along which the arrow travels when departing the bow. In operation, the archer, after affixing the harness to his or her body, secures the bowstring to the bowstring release mechanism carried by the harness flexes the bow limbs by forcing the central section of the bow away from the harness with both arms and then activates the bowstring release mechanism to launch the arrow.

The archery apparatus described in the '299 application greatly increases the draw weight, i.e., force exerted on the drawstring by the archer and therefore the stored energy and arrow exit velocity, over that possible with conventional bows. The retractable arrow rest described in the '299 application (mechanically coupled to the cables attached between the ends of the bow limbs) allows the use of shorter and stiffer arrows (preferable with increased draw weights) and eliminates any contact between the arrow rest and the vanes on a departing arrow.

I have developed certain improvements useful with the two handed bow described in the '299 application as well as with conventional bows i.e. collapsible hand grip arrangement, a bowstring release mechanism which reduces the bowstring release actuating force and a non-mechanically actuated retractable arrow rest.

SUMMARY OF THE INVENTION

An archery apparatus in accordance with the present invention for launching an arrow along a shooting axis comprises a bow having a central section or elongated riser and a resilient limb mounted on each end of the riser. A bowstring is connected between the free ends of the limbs and includes a nocking point for engagement with the neck of an arrow. A pair of hand grips are pivotally mounted on each side riser adjacent the shooting axis. The pivotal mounting arrangement releasably secures the hand grips in a collapsed non-operating position along the riser in planes parallel to the plane of movement of the bowstring and in an operating position at an angle (preferably between 30° to 60°) to the bowstring movement plane.

A bowstring release mechanism in accordance with the invention, which may be carried on a harness worn by the archer, includes a body member having an elongated opening with an entrance for receiving the bowstring. At least one and preferably two retaining arms having first and second ends are pivotally mounted on the body for movement between a bowstring retaining position in which the first ends block the entrance and a release position in which the first ends are removed from the entrance to allow the bowstring to move out of the opening Actuating means are provided to selectively (a) apply a force to the second ends of the retaining arms to pivot the arms so that the first ends thereof close the entrance to the opening and (b) remove the force from the second ends to allow the first ends to pivot away from the entrance and release the bowstring.

A retractable arrow rest in accordance with the invention includes a bracket pivotally mounted on the riser and having an upper shaft engaging surface for positioning the arrow along the shooting axis when the bowstring is in the full draw position. The bracket defines an opening below the shaft engaging surface. The arrow rest is retracted away from the shooting axis by an electrically actuated mechanism which may respond to the movement of the bowstring or to a signal delayed from the time that the bowstring is released. In its retracted position the opening may straddle the bowstring in its post release position to enable the arrow rest to be positioned adjacent the bowstring in its at rest position.

DESCRIPTION OF THE PREFERRED EMBODIMENT

Figure 2:
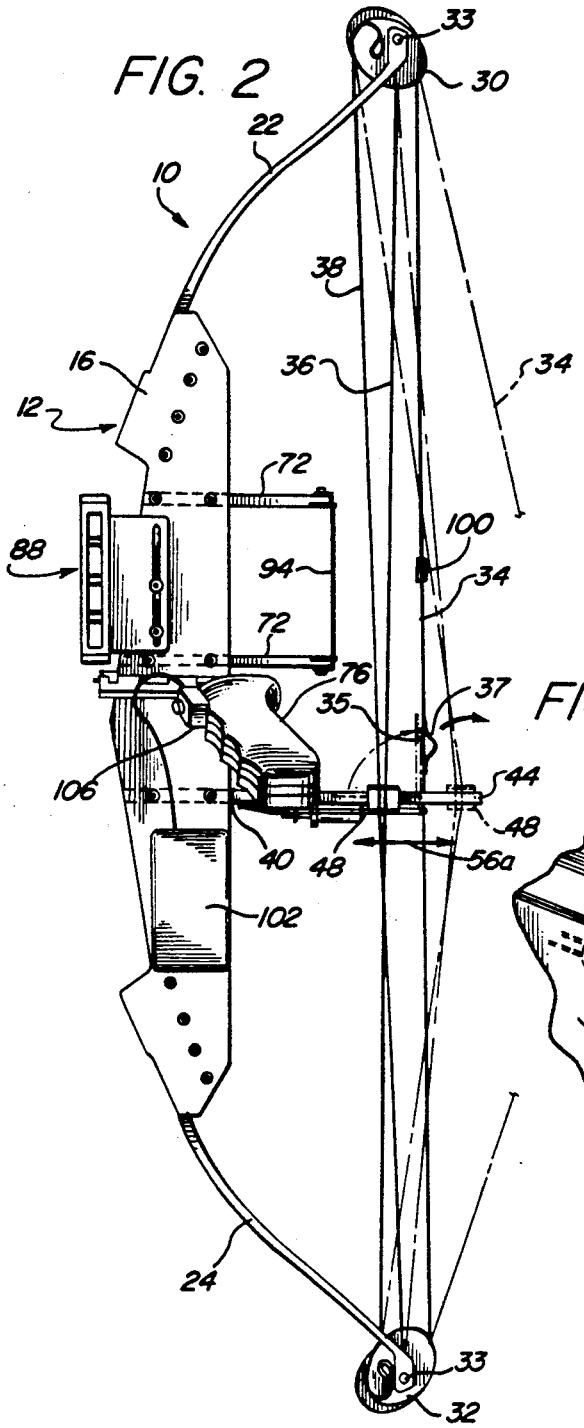
FIG. 2 is a side elevational view of the bow of FIG. 1.
Figure 1:
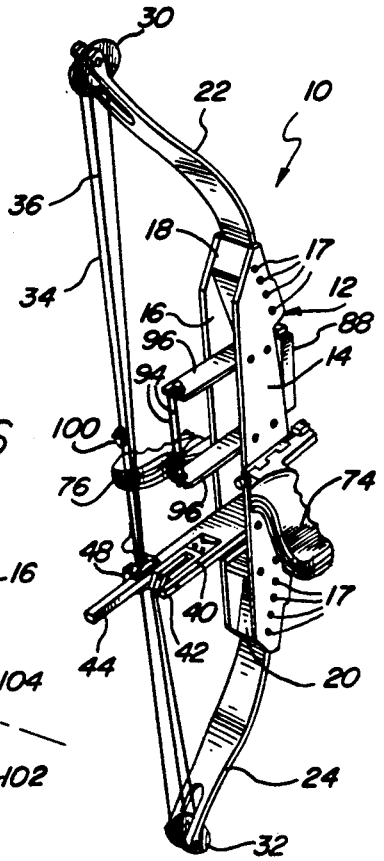
FIG. 1 is a perspective view of a two-handed bow with the features of my invention.

Referring now to the drawings and particularly to FIGS. 1–4, a compound bow 10 includes an elongated central section frame or riser 12. The riser 12 may be made of aluminum or other suitable material and comprises a pair of side plates 14 and 16 which are secured together at their ends via bolts 17 through limb attachment blocks 18 and 20. Flexible limbs 22 and 24, made of conventional materials such as glass fibers and resin (e.g. Fiberglas®), carbon or graphite composites, are secured to each end of the blocks 18 and 20 via bolts and adjustment nuts 26 and 28, respectively in a conventional manner. (Fiberglas is a trademark of Owens Corning). A fulcrum member (not shown) is positioned within each of the blocks 18 and 20 and engages the respective limb adjacent the end of the block to allow the tension on the limbs to be adjusted by the nuts 26 and 28 as is well known.

Conventional eccentric wheels or cammed pulleys 30 and 32 are rotatably mounted on the ends of the limbs 22 and 24, via shafts 33, respectively. A bowstring 34 has its ends connected to the pulleys as illustrated and includes a nocking point 35 adapted to engage the nock on an arrow. See FIG. 2. A short cord (or loop) 37 has its ends secured to the bowstring on each side of the nocking point and cooperates with a bowstring release mechanism to be described. The cord forms part of the bowstring. A pair of cables 36 and 38 have one end connected to a respective shaft 33 and the other end connected to a respective pulley. This arrangement is typical of compound bows and provides a decreased full draw weight as compared with the peak draw weight, commonly referred to as let-off.

Figure 6:
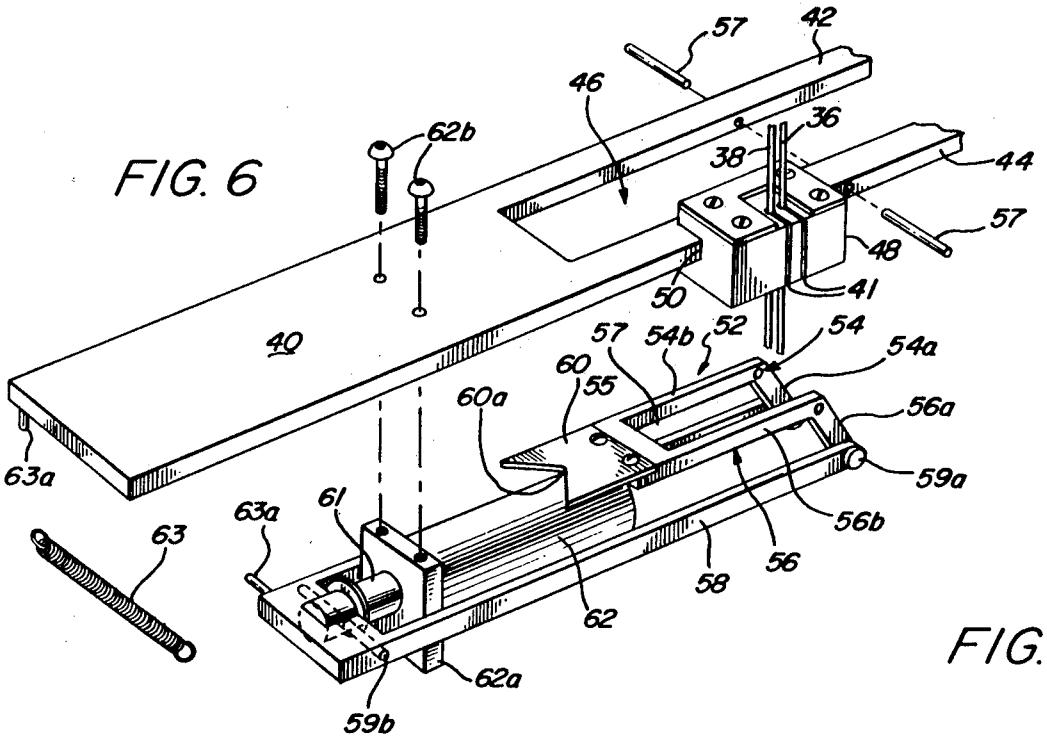
FIG. 6 is an perspective view of the arrow rest of FIG. 5 in a disassembled state.

A cable guard 40 in the form of an elongated plate is mounted on the riser 12 via suitable bolts and extends horizontally with respect to the vertically oriented riser 12. The cable guard 40 has a forked end adjacent the bowstring with a pair of legs 42 and 44 extending on each side of a U-shaped opening 46 (FIG. 6), which opening is centered about the plane of movement of the bowstring, (hereinafter referred to as the "central plane"). A cable guide 48 having a channel 50 on one side thereof is slidably mounted on the leg 44 of the cable guard as is illustrated in FIG. 6. The mid-sections of cables 36 and 38 are secured to the cable guide 40 via grooves 41. The cable guide holds the cables to one side of the central plane so that the cables will not interfere with the path of the arrow shaft and its vanes.

Figure 5:
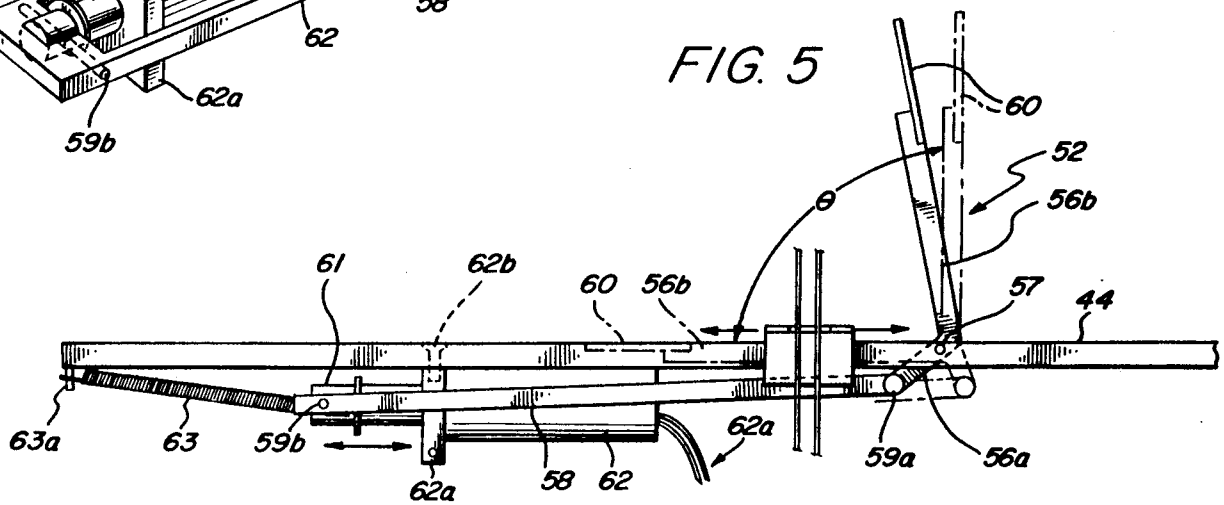
FIG. 5 is a side elevational view of a retractable arrow rest in accordance with the present invention.

Referring now to FIG. 5 and 6 an arrow rest 52 in the form of a generally U-shaped bracket includes downwardly depending legs 54 and 56 pivotally mounted to the inside of the cable guard legs 42 and 44 via pins 57. The lower ends 54*a* and 56*a* of the legs 54 and 56 form an angle with respect to the upper ends 54*b* and 56*b* thereof as shown. An upwardly extending plate 60 with a V-notch 60*a* therein is secured to the top section 55 of the bracket 54 to support the shaft of the arrow. The top section 55 and the legs 54 and 56 define a U-shaped opening 57 for accommodating the bowstring in its post release position as will be explained.

Figure 7:
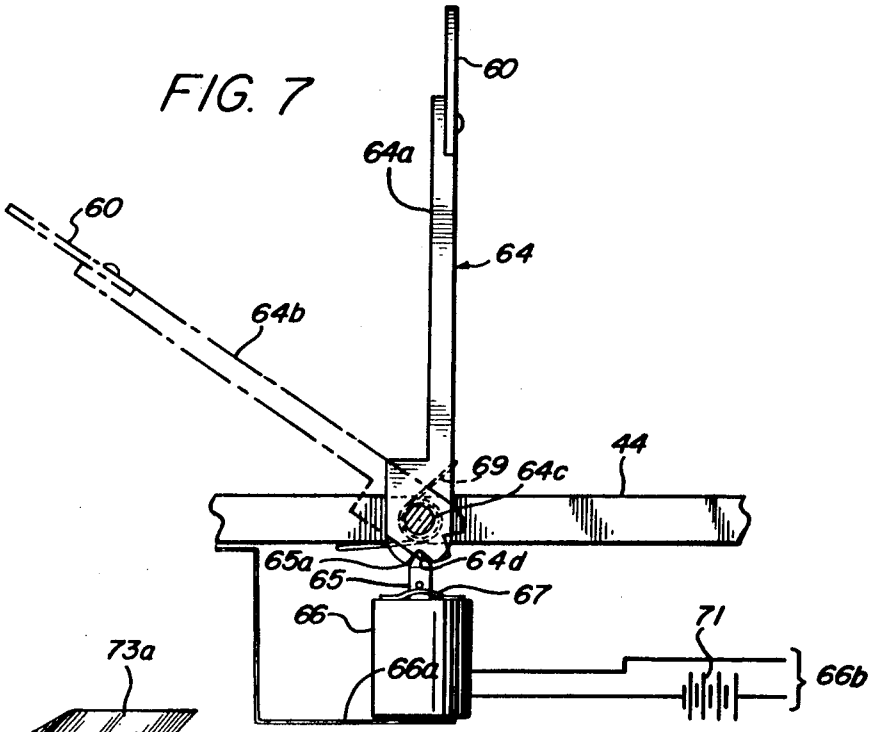
FIG. 7 is a diagrammatic view of another embodiment of a retractable arrow rest in accordance with my invention.

A U-shaped actuating arm 58 is pivotally connected at one end via pins 59*a* to the terminal ends of the legs 54 and 56 and at the other end via a pin 59*b* to a plunger 61. A solenoid 62 when actuated via a control current signal through leads 62*a* moves the plunger and the arm 58 to the right in FIG. 5, thereby rotating the bracket 52 counterclockwise about the pivot pins 57. This action retracts the arrow rest from the shooting axis and eliminates interference with the vanes or the feathers on the arrow as the arrow leaves the bow on its way to the target. The solenoid 62 is secured to the cable guard 40 by means of a plate 62*a* and bolts 62*b*. A spring 63 is connected between the cable guard and the actuating arm 58 via pins 63*a* to bias the actuating arm 58 and plunger 61 in a direction (to the left in FIG. 5) to raise the arrow rest to its vertical or operating position (shown by the dashed lines in FIG. 5). The length of the plunger 61 determines the angle $\theta$ through which the arrow rest rotates from the vertical to its retracted position. It should be noted that the angle $\theta$ need not be 90° but only sufficient to ensure that the top plate 60 is removed from the path of the vanes on the arrow. FIG. 7 illustrates another embodiment of a retractable arrow rest in accordance with my invention. In this embodiment an arrow rest bracket 64 in the form of an inverted L carries the plate 60 at the top section 64*a* thereof. A downwardly extending leg 64*b* is pivotally mounted on the cable guard leg 44 by pin 64*c*. The terminal end of the leg 64*b* is notched at 64*d* to mate with a tapered end 65*a* of a plunger 65. A solenoid 66 (secured to the cable guard 40 via bracket 66*a*) when actuated retracts the plunger from the notch 64*d*. A spring 67 extends upwardly from the solenoid and bears against a pin 68 extending through the plunger as shown. The spring 67 biases the plunger toward the tapered opening 64*d*, thereby holding the arrow rest bracket 64 in a vertical position absent actuation of the solenoid. A spring 69 is connected between the cable guard leg 44 and the leg 64*b* of the arrow rest bracket and biases the bracket in a counterclockwise direction (as shown in FIG. 7) to retract the arrow rest from the path of the arrow when solenoid 66 is actuated to remove the plunger from the notch or detent 64*d*. The solenoid 66 is actuated by current from battery 71 when the leads 66*b* are connected together by a switch such as that illustrated in FIG. 8.

Figure 8:
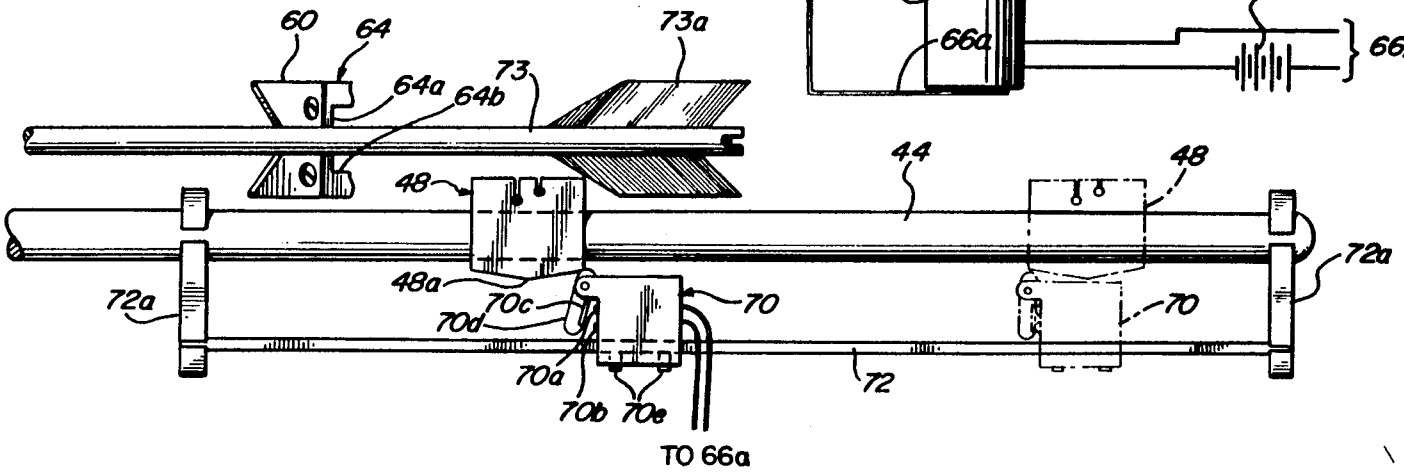
FIG. 8 is an enlarged side elevational view of a switching mechanism for actuating the arrow rest of FIG. 5 or 7.
Figure 11:
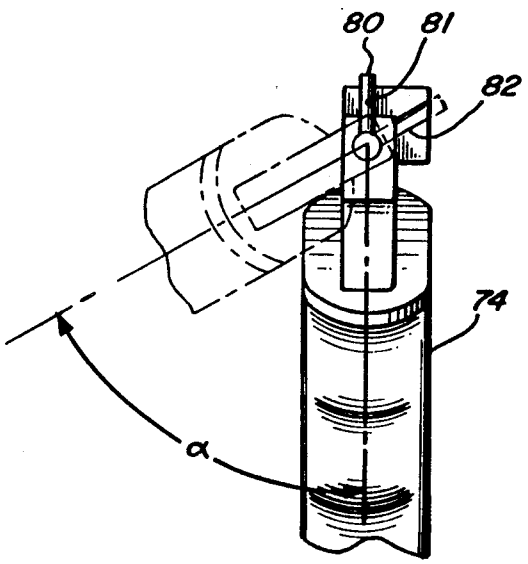
FIG. 11 is a front elevational view, partially broken away, of the hand grip of FIG. 9.
Figure 10:
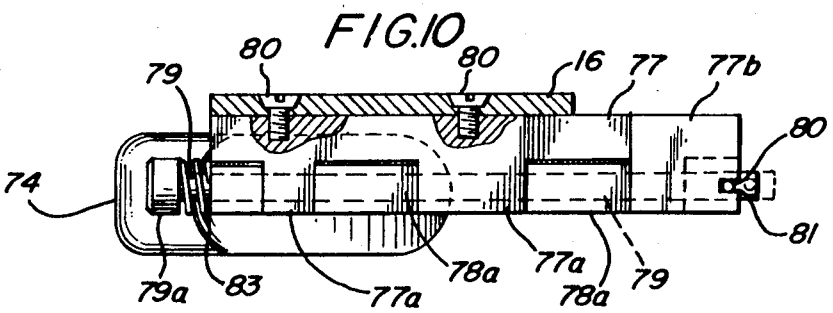
FIG. 10 is a top plan view of the hand grip arrangement of FIG. 9 including one of the riser side plates to which the hand grip is secured.
Figure 9:
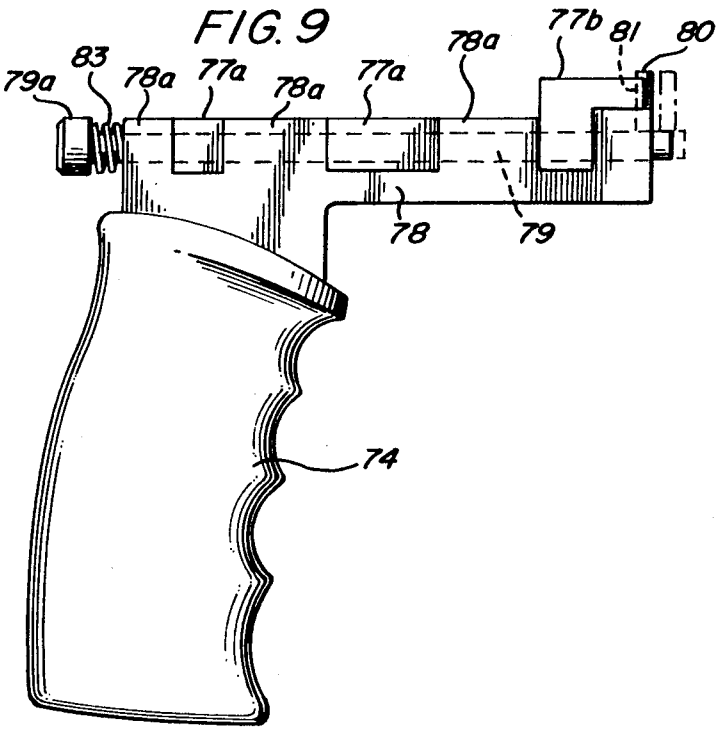
FIG. 9 is a side elevational view of one of the collapsible hand grips in accordance with my invention.

Referring now to FIG. 8, a micro switch 70, for actuating the solenoid 66 (or 62, FIG. 5) is slidably mounted on a square rod 72 which in turn is secured on the cable guard leg 44 by brackets 72*a*. The switch 70 carries contacts 70*a* and 70*b* which are connected together via a moveable contact 70*c* affixed to a pivotally mounted arm 70*d*. The switch may be positioned at any desired location along the rod 72 by means of set screws 70*e* in a conventional manner.

The cable guide 48 (illustrated as having an outwardly projecting inner face 48*a*), activates the switch 70 and the solenoid 66 during its travel from the full draw position to the at rest position. The position of the switch 70 on the support rod 72 may be adjusted to cause the solenoid to be actuated when the cable guide reaches any desired point along the cable guard.

The switch contacts 70a, 70b and 70c are not made during the movement of the cable guide from the at rest position to the full draw position because the switch arm 70d is rotated clockwise (FIG. 7) and away from the fixed contacts during this operation. Upon release of the bowstring, the cable guide 48 travels along the cable guard toward the riser and upon reaching the switch 70 rotates the arm 70d in a counterclockwise direction to make contacts 70a, 70b and 70c as is illustrated by the phantom lines in FIG. 8. Current from the battery 71 then operates the solenoid 66 to withdraw the plunger 65 allowing the spring 69 to rotate the arrow rest bracket 64 out of the way of the arrow 73 and the vanes 73a thereon. The arrow rest bracket 64 may be manually repositioned in the upright or operating position before the next arrow is to be launched.

Referring now to FIGS. 4 and 9–11, a pair of downwardly extending hand grips 74 and 76 are pivotally mounted on the riser 12 on opposite sides of the central plane via hinge plates 77 and 78 with interleaved knuckles 77a and 78a and hinge pin 79. The plates 77 are mounted on the riser side plates 14 and 16 by screws 80. The hand grips 74 and 76 are molded on or otherwise suitably secured to the plates 78. Each hinge pin 79 is keyed to the plate 78 and rotates therewith. The hinge pin carries an indexing pin 80 which mates in slots 81 or 82 formed in an enlarged end 77b of the plate 77. An actuating knob 79a is formed on the other end of the hinge pin 79. A spring 83 is disposed between the knob 79a and the plate 78 to bias the hinge pin 79 rearwardly (FIG. 10) and maintain the pin 80 in one of the slots 81 or 82. The slots 81 and 82 form an acute angle $\alpha$ at their intersection which is preferably within the range of 30° to 60° and most preferably about 45°. When the pins 80 are in the slots 81 the hand grips are collapsed along the sides of the riser i.e. in planes parallel to the central plane. The hand grips may be rotated to the operating position by pushing the hinge pins to unseat the pins 80 from the slots 81, rotating the hand grips through the angle $\alpha$ and allowing the pins 80 to seat in the slots 82.

Figure 4:
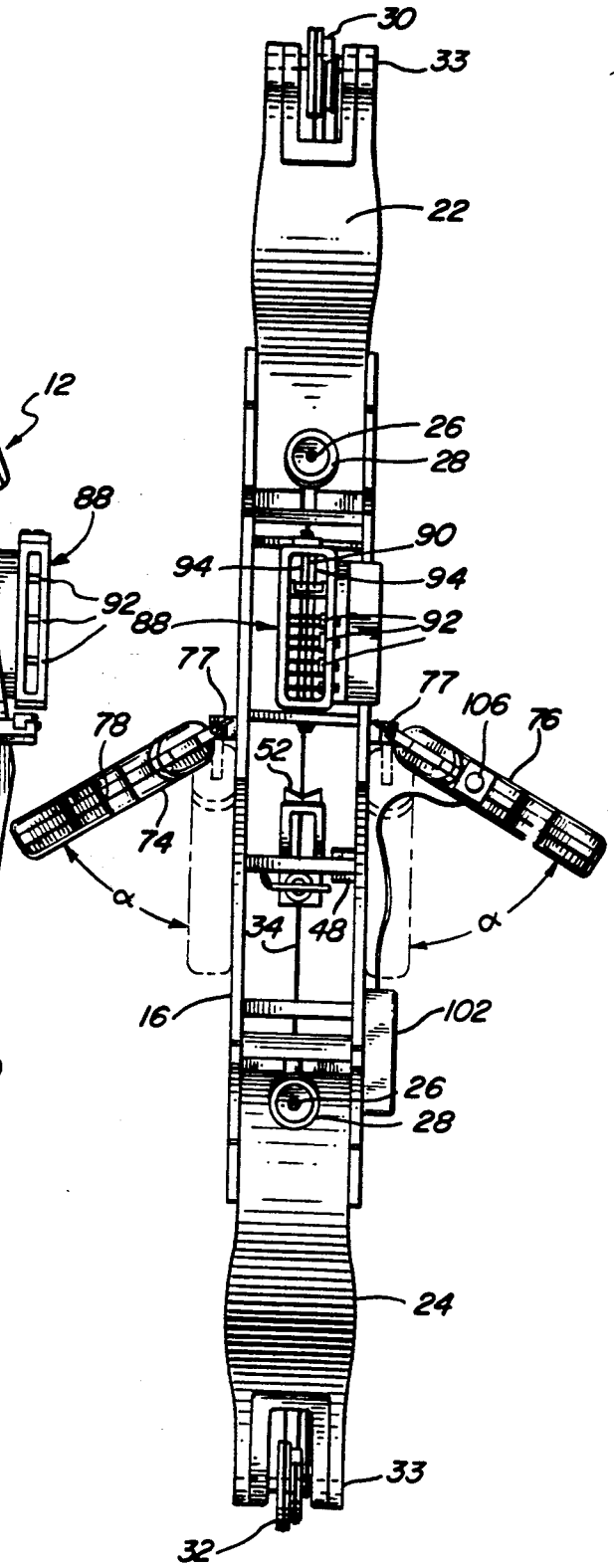
FIG. 4 is a front elevational view of the bow.

In their operational position, the hand grips allow the archer to apply force to the central section or riser of the bow with both arms to move the bowstring to its full draw position as will be explained more fully. The centers of the hand grips 74 and 76 in their operating positions preferably lie in a plane which encompasses the shooting axis and is perpendicular to the central plane as is illustrated in FIG. 4. This arrangement allows the archer to apply the draw weight force directly in line with the shooting axis.

Referring again to FIGS. 1–4, the bow is provided with a bow sight 88 which is mounted on the front of the riser 12, between the side plates 14 and 16. The bow sight includes a vertical cross-hair 90 aligned with the central plane as well as horizontally oriented range lines 92.

A pair of vertically oriented antitorque sighting lines 94 are mounted on rearwardly extending horizontal brackets 96 (bolted to the riser plates 14 and 16). The antitorque lines are positioned on opposite sides of the central plane and between the bowstring and the bowsight.

A conventional peep sight 100 is carried by the bowstring so that when the bowstring is at its full draw position the archer can, by looking through the peep sight, position the riser 12 so that the antitorque lines 94 frame the vertical cross-hair 90 and the target to allow the archer to eliminate any twisting of the bow.

Figure 16:
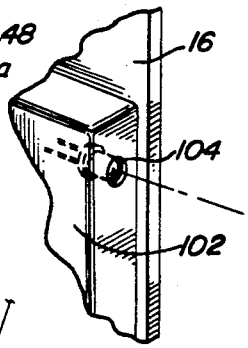
FIG. 16 is an enlarged fragmentary view of the arrow release signal transmitter carried by the bow illustrating the light emitting diode therein.
Figure 3:
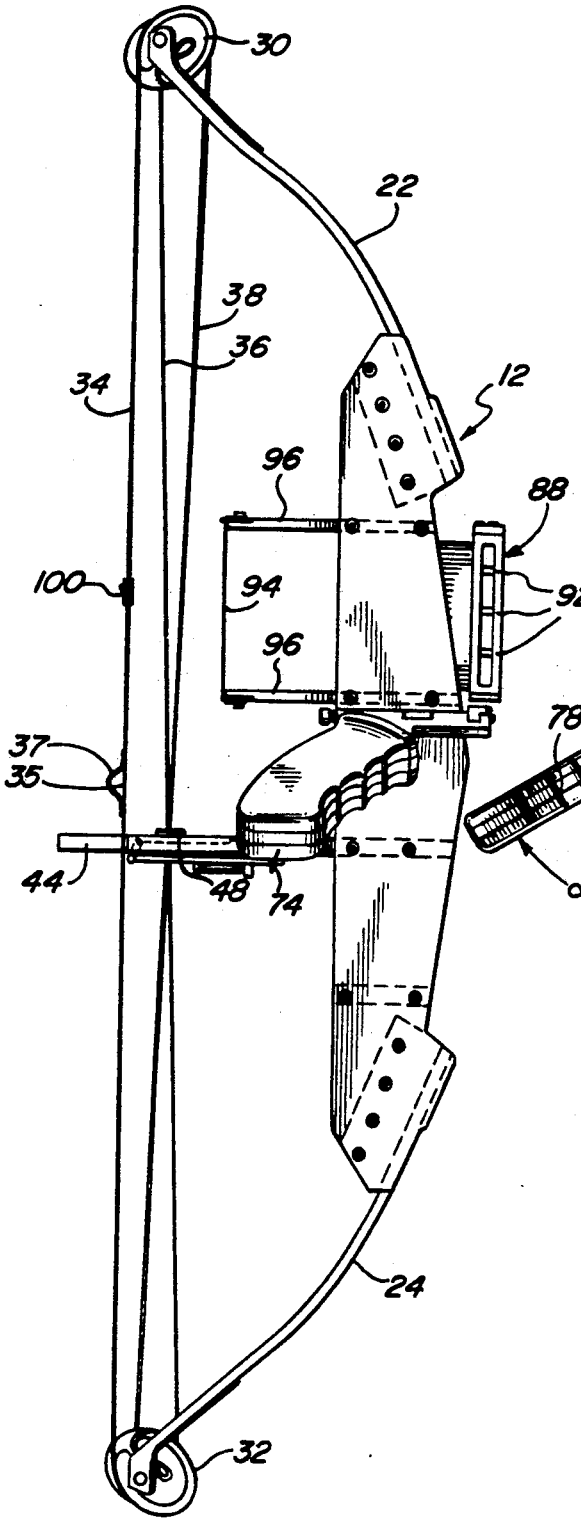
FIG. 3 is a elevational view of the bow on the opposite side to that shown in FIG. 2.

As is shown in FIGS. 2, 4 and 16, a bowstring release signal generating and transmitting unit 102 is also mounted on the riser 12 (via side plate 16) and includes a light transmitting diode 104 for transmitting a light signal toward the rear of the bow. A manually operated switch 106 is mounted adjacent the left hand grip 76 to enable the archer to activate the transmitter as will be explained in more detail.

Figure 12:
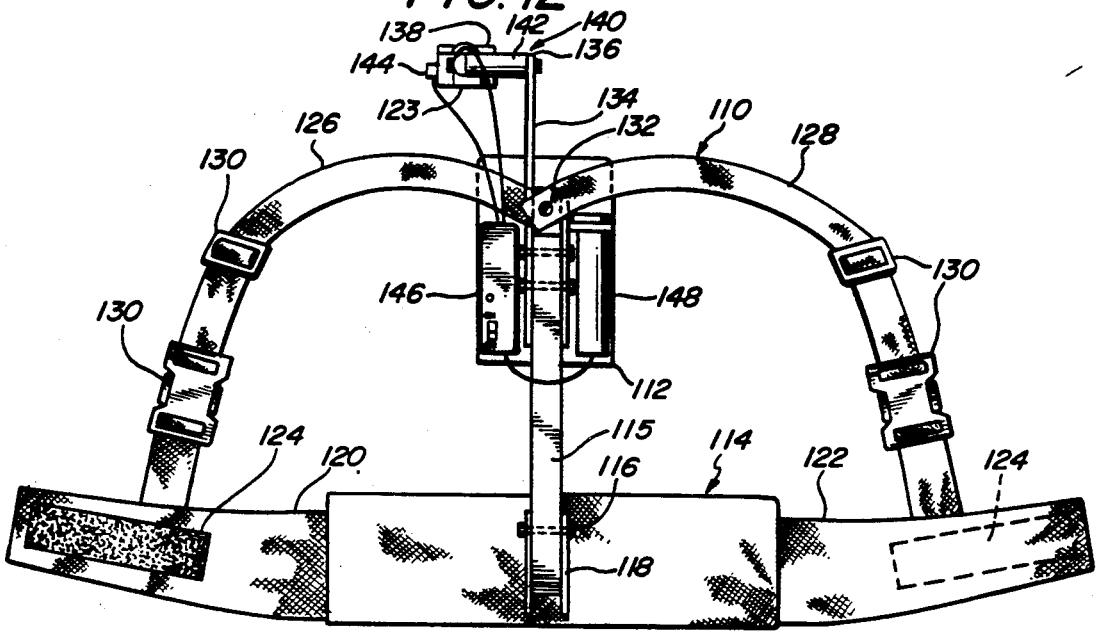
FIG. 12 is a rear elevational view of a harness assembly which carries my novel bowstring release mechanism.

Referring now to FIG. 12, a harness assembly 110 includes a rigid back plate 112 pivotally connected to a flexible belt or strap 114 via a bar 115, a bolt 116 and rigid channel bracket 118. The belt 114 includes extended arm portions 120 and 122 which are arranged to wrap around the archers waist and be releasably secured together by a suitable fastener such as velcro strips 124. Shoulder straps 126 and 128, provided with adjustable buckles 130, are suitably secured to the belt extensions 120 and 122 (e.g. by sewing) and the back plate via a rivet 132. The back plate 112 may be curved to conform to the archer's back and padded for the comfort.

An extension bar 134 is bolted to the bar 115 adjacent the back plate 112. A bowstring release mechanism 138 is secured to the upper end 140 of the bar 134 via a horizontally oriented arm 142 and horizontally oriented bracket 143 (shown in FIGS. 13–15). An optic or light detector 144, in the form of a light sensitive solid state device (forming part of the receiver), is mounted on one side of the bracket 143 for sensing the bowstring release signal from the transmitter carried on the bow. The output of the optic detector is supplied to an electronic circuit module 146 (mounted on back plate 112) which activates the bowstring release mechanism. A battery 148 is also carried on the back plate 112 for supplying power to the receiver. The transmitter and receiver circuits are described in more detail in conjunction with FIGS. 16 and 17.

Figure 13:
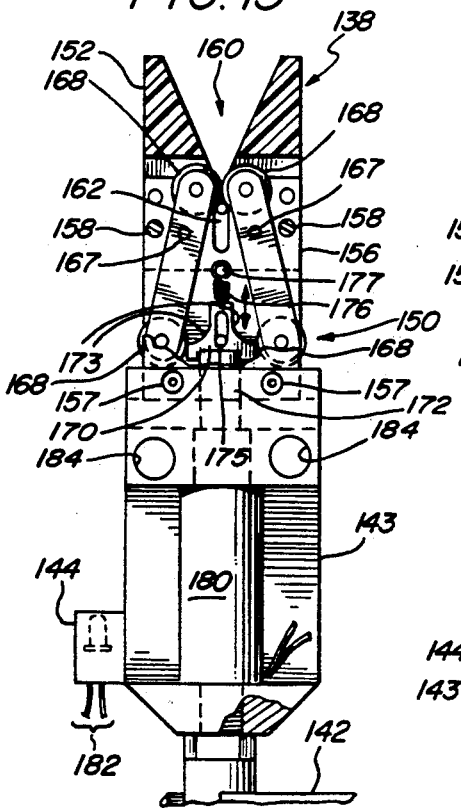
FIG. 13 is a enlarged plan view partially broken away of my novel bowstring release mechanism showing the bowstring retaining position.
Figure 14:
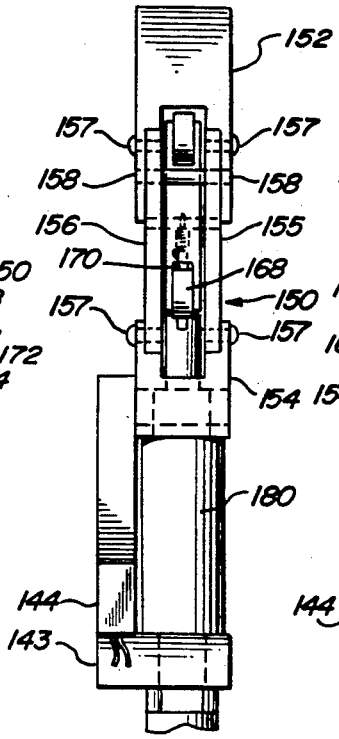
FIG. 14 is an enlarged side elevational view of the bowstring release mechanism of FIG. 9.
Figure 15:
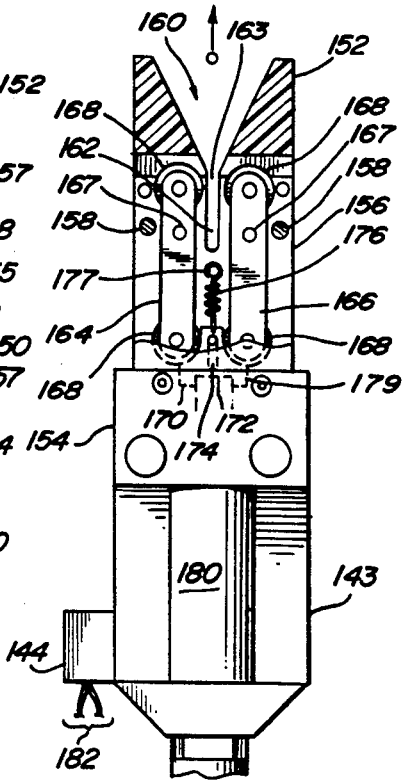
FIG. 15 is another enlarged plan view partially broken away of the release mechanism of FIG. 9 showing the bowstring release position.

A bowstring release mechanism 138 in accordance with my invention is illustrated in FIGS. 13–15. The mechanism comprises a body 150 having rectangular front and rear sections 152 and 154. Front and bottom rectangular plates 155 and 156 (FIG. 14) secure the front and rear sections of the body 150 together via screws 157. Pins 158 extend through bores in the plates 156 and 157 and the front section 152 to provide stability for the front section. The front section 156 has a V-shaped opening 160 therein for guiding the cord or loop 37 of the bowstring 34 into a vertically oriented bowstring receiving slot 162 (aligned with the plane of movement of the bowstring) through an entrance 163. A pair of bowstring retaining arms 164 and 166 (FIG. 15) are pivotally mounted between the plates 155 and 156 by pins 167 and include rollers 168 rotatably mounted at each end thereof as shown. A cam 170 carried on the end of a plunger 172 is positioned between the plates 155 and 156 and includes a pair of arcuate surfaces 173 having the same radius as the rollers 168. The cam defines a centrally located slot 174 (FIG. 15) through which a post 175 (FIG. 13) extends for limiting the movement of the cam toward and away from the front of the bowstring release body 150. The post 174 is mounted on the lower plate 156.

A spring 176 extends between post 177 and the front end of the cam 170 for biasing the cam toward the front of the release mechanism as is shown in FIG. 13. In the bowstring retaining position (FIG. 13), the cam 170 forces the rollers carried on the rear (second) end of the retaining arms outwardly thereby causing (1) the arms 164, 166 to pivot about pins 167 and (2) the rollers at the front (first) end of the arms to contact each other, closing the entrance to the bowstring retaining slot 162. It should be noted that the cam 170 includes flat surfaces 179 (parallel to the plane of movement of the bowstring) which engage the surfaces of the rear rollers 168 in the bowstring retaining position. This arrangement allows a small spring (174) to hold the arms 167 in the bowstring retaining position against a large draw weight.

A solenoid 180 is mounted on the rear section 154 of the body 150 and when actuated by an electrical actuating signal applied to conductors 182 withdraws the plunger and the cam 170 thereby removing the force from the rollers at the rear of the retaining arms so that the arms can pivot away from the entrance 163 to the bowstring release position as shown in FIG. 15. The body 150 is retained on the bracket 143 by a pair of cylindrical bores 184 which slide over support posts (not shown) on the bracket 143. The optic detector 144 is mounted on the bracket 143 by suitable means such as metal screws.

The bowstring release mechanism of FIGS. 13–15 provides an improved ratio of the bowstring release actuating force (i.e. supplied by the plunger) to the force being applied to the retaining arms 164 and 166 by the bowstring (i.e., draw weight) as compared to the prior art mechanisms. It should be noted that the plunger 172 need not be coupled to a solenoid but may be manually withdrawn. This arrangement would be particularly useful with conventional one handed bows.

Figure 17:
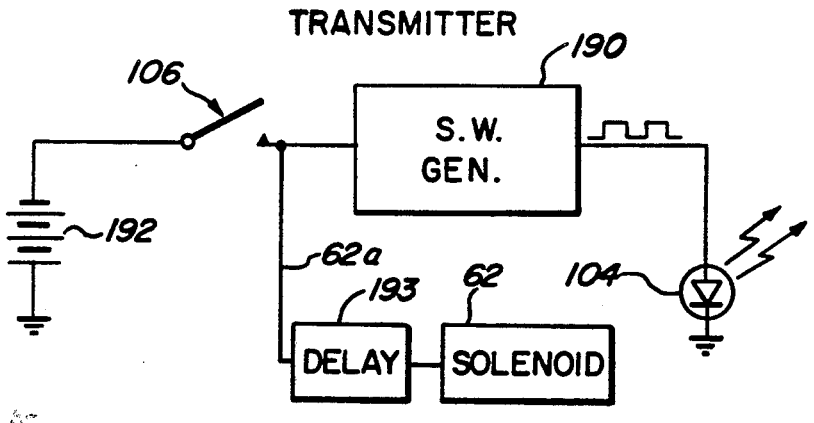
FIG. 17 is a block diagram of a transmitter circuit carried by the bow of FIG. 1 for generating a bow string release and arrow rest retraction signal.
Figure 18:
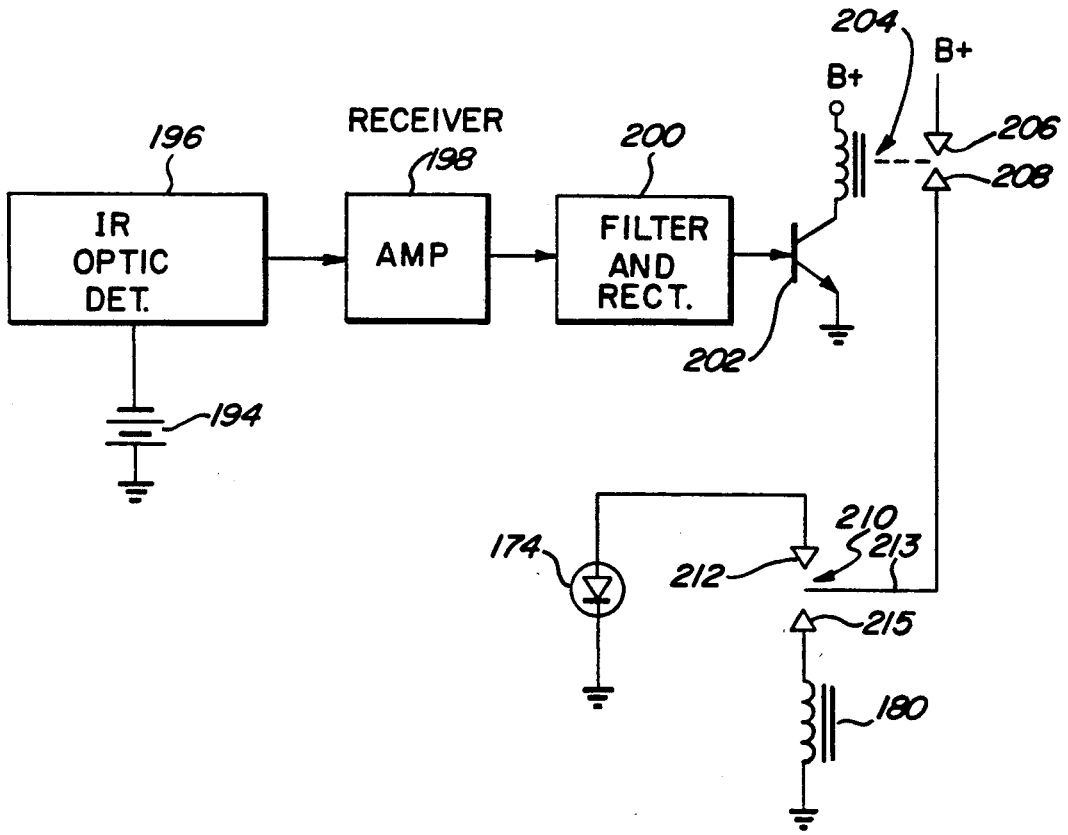
FIG. 18 is a block diagram of a receiver circuit carried by the harness assembly of FIG. 5 for sensing the transmitted bowstring release signal and actuating the bowstring release mechanism.

A bowstring release signal transmitter and receiver are illustrated in FIGS. 17 and 18. The transmitter includes a square wave generator 190 for generating a high frequency signal (e.g. 40 KHz), the light emitting diode 104, the switch 106 and a battery 192 as is shown in FIG. 17. The retractable arrow rest actuating solenoid 62 of FIGS. 5 and 6 (or the solenoid 66 of FIG. 7) can also be operated from switch 106 through a suitable delay circuit 193 connected to switch 106 via lead 62*a*.

The receiver shown in FIG. 18, includes a battery 194, the light detector 144 (preferably sensitive to infrared) and an amplifier 198. The output of the amplifier is applied to a bandpass filter and rectifier circuit 200 which applies an output signal to operate a switch such as transistor 202. The switch 202 in turn operates a relay 204 from the battery (designated B+). The relay when activated closes contacts 206 and 208 to supply current from the B+supply to a manually operated single-pole-single-throw-switch 210. When the switch 210 is operated to make contacts 212 and 213, a light emitting diode informs the archer that the transmitter and receiver are operating properly. When the switch is operated to make contacts 213 and 215 and the relay 204 operated (i.e. in response to the bowstring release signal from the transmitter) the bowstring release solenoid 180 is actuated to release the bowstring.

Figure 19:
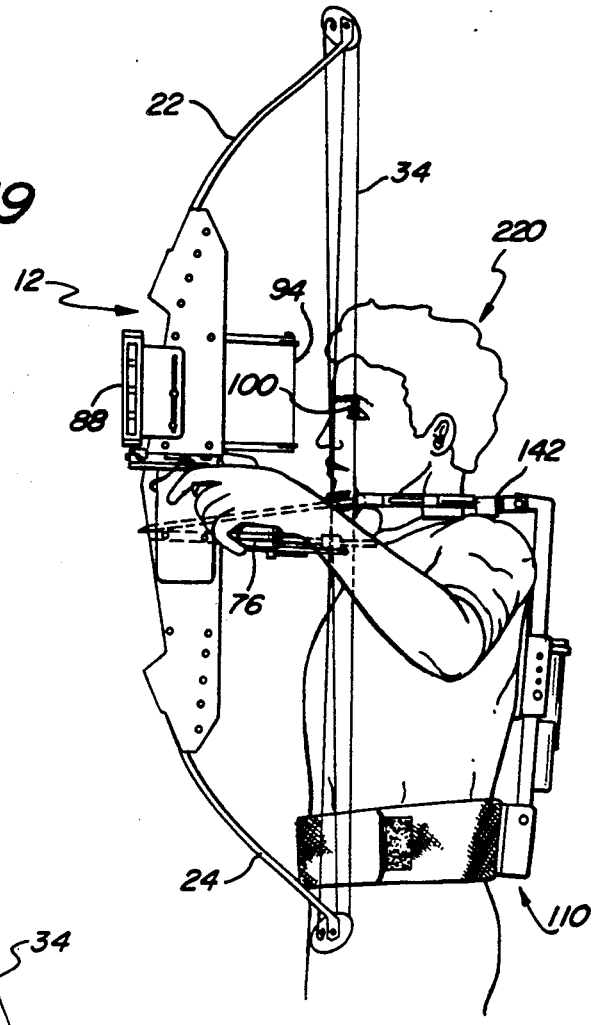
FIG. 19 is a side elevational view of the bow held by an archer in the at rest position with the harness assembly strapped to the archer's body.
Figure 20:
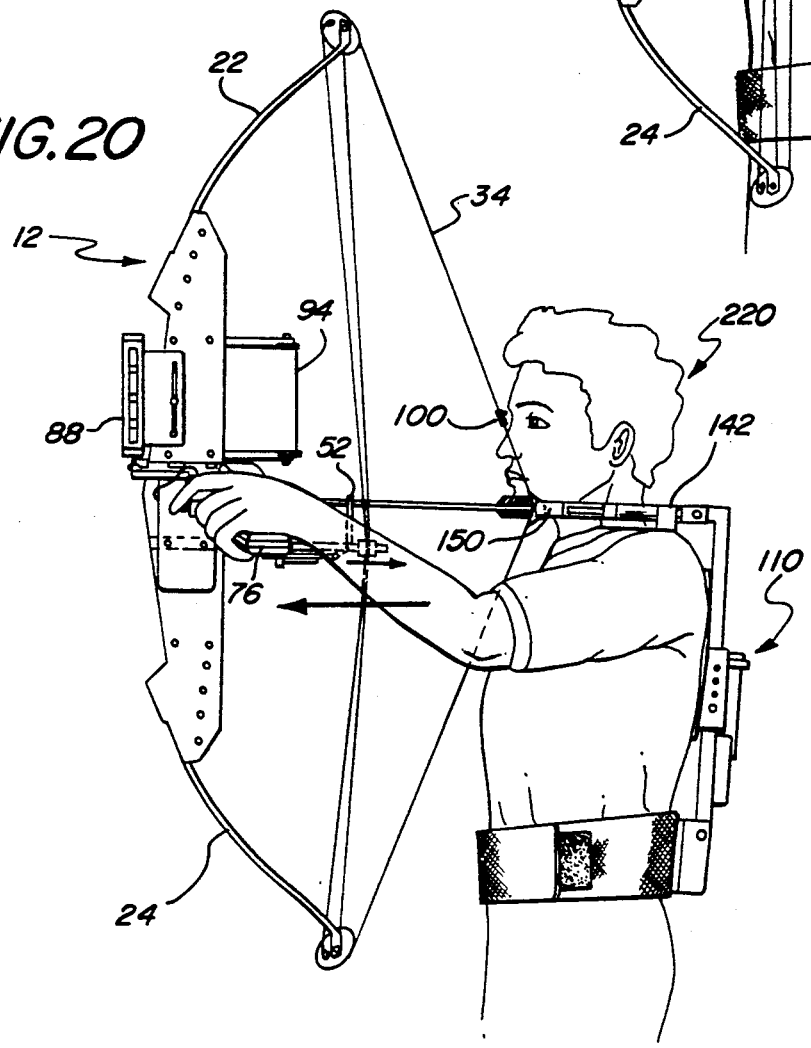
FIG. 20 is a side elevational view similar to FIG. 19 showing the archer pushing the bow away from the harness toward the full draw position.

The operation of the archery apparatus will now be explained in reference to FIGS. 18 and 19. Initially the archer (designated 220) straps the harness 110 around his or her body so that the back plate is positioned along the upper back and the bowstring release mechanism positioned over one shoulder and adjacent the neck. It should be noted that the shoulder straps are not shown in FIGS. 18 and 19.

The archer actuates the bowstring release transmitter switch 106, then places the nock of an arrow in the bowstring, inserts the bowstring cord or loop through the entrance 163 and into the bowstring retaining slot 162. The switch 106 is then released, deactivating the arrow rest solenoid 62 and the bowstring release solenoid 180. As a result, the arrow rest is pulled into vertical position and the bowstring retaining arms 164 and 166 are pivoted (via spring 176) until the rollers 168 close the slot 162. The archer then places both hands on the hand grips and pushes the bow away from the body and harness with both arms as is illustrated in FIG. 19. With the bowstring in its full draw position, the archer aligns the bow until the vertical cross-hair 70 is centered between the anti-torque lines 94 and in line with a desired target as viewed through the peep sight. The bowstring release switch 106 is then actuated which causes the transmitter, via the light emitting diode 104, to transmit a bowstring release signal (i.e. square wave light signal) toward the optic detector 144 on the harness. The receiver detects the bowstring release signal and applies an actuating signal to solenoid 180 which withdraws the plunger 172 and allows retaining arms to pivot and to release the bowstring. Upon release the bowstring accelerates the arrow to a high velocity. After a short time delay the arrow rest solenoid 62 is actuated and retracts the arrow rest 52 away from the path of the vanes on the back of the arrow. In its post release position the bowstring travels forwardly beyond its at rest position and enters the opening 57 in the arrow rest bracket 54. The bow may now be prepared to shoot another arrow.

If the bow is equipped with the retractable arrow rest actuating mechanism of FIGS. 7 and 8 the movement of the mid-sections of the cables 36 and 38 slide the cable guide 48 along the cable guard causing the switch 70 to close and actuate solenoid 66. Actuation of solenoid 66 withdraws plunger 65*a* from the detent 64 in the end of the arrow rest bracket 64 allowing the spring 69 to retract the arrow rest from the path of the arrow.

There has been described an archery apparatus which provides a significant improvement in the accuracy and ease of operation of two handed and one handed bows. Various modifications to the described apparatus will be apparent to those skilled in the art without involving any departure from the spirit and scope of my invention as defined in the appended claims.

What is claimed is:

1. An archery apparatus for launching an arrow along a shooting axis comprising:

a elongated riser having limb mounting means at each end thereof and an arrow receiving opening therein;

a pair of resilient limb members, each limb member having one end thereof secured on a respective limb mounting means of the riser and a free end remote from the riser;

a bowstring connected between the free ends of the limb members and having a nocking point for engagement with the nock of an arrow;

a pair of hand grips for accommodating the left and right hands of the archer;

means for pivotally mounting the hand grips on opposite sides of the riser adjacent the arrow receiving opening, the mounting means being constructed and arranged to releasably secure the hand grips in a collapsed non-operating position along the riser in planes substantially parallel to the plane of movement of the bowstring and to releasably secure the hand grips at an acute angle $\alpha$ to the plane of movement of the bowstring in an operating position; and a harness adapted to be worn by the archer and supporting a bowstring release means thereon for selectively holding and releasing the bowstring adjacent the nocking point.

2. The archery apparatus of claim 1 wherein each hand grip includes a bottom portion which is adapted to be positioned adjacent the little finger of the archer's hand and a top portion adapted to be positioned adjacent the index finger of the archer's hand and wherein the pivotally mounting means for each hand grip includes a hinge pin connecting the top portion of the hand grip to the riser, the hinge pin being aligned along an axis parallel to the shooting axis.

3. The archery apparatus of claim 2 wherein the mounting means includes a bracket secured on one side of the riser and a plate secured to the hand grip, the bracket and the plate forming a hinge adjacent the riser and positioned above the shooting axis.

4. The archery apparatus of claim 3 wherein the mounting means further includes an indexing pin secured at one end of the hinge pin and a pair of spaced detents formed in the adjacent end of the bracket for receiving the indexing pin, the hinge pin being moveable longitudinally of and keyed for rotation with the bracket and means for biasing the hinge pin in a direction to seat the indexing pin in the detents.

5. The archery apparatus of claim 1 wherein the angle $\alpha$ is about 45°.

6. The archery apparatus of claim 1 wherein the bowstring release means includes a body defining an elongated opening with an entrance for receiving the bowstring, at least one retaining arm having first and second ends pivoted on the body for movement between a bowstring retaining position in which the first end blocks the entrance to bowstring receiving opening and a bowstring release position in which the first end is removed from the entrance to release the bowstring, actuating means for selectively applying a force to the second end of the retaining arm to pivot the arm so that the first end thereof closes the entrance to the bowstring opening and for selectively removing the force from the second end of the retaining arm to allow the first end of the retaining arm to pivot away from the entrance to the bowstring opening.

7. The archery apparatus of claim 6 wherein said at least one retaining arm comprises a pair of arms pivoted on the body member on opposite sides of the bowstring opening with each of the arms having first and second ends and wherein the actuating means selectively forces the second ends of both arms outwardly away from the opening or allows the second ends of both arms to move inwardly toward the opening to cause the first ends to close and open the entrance to the bowstring opening, respectively.

8. The archery apparatus of claim 7 wherein the actuating means comprises a cam positioned rearwardly of the bowstring opening and moveable parallel to the shooting axis for engaging the second ends of the retaining arms, a spring for biasing the cam toward the bowstring opening to force the second ends of the retaining arms outwardly in the bowstring retaining position and a plunger connected to the cam for moving the cam away from the bowstring opening and allow the second ends of the retaining arms to move inwardly to the bowstring release position.

9. The archery apparatus of claim 8 wherein the bowstring release means further includes a roller individually mounted on each of the first and second ends of each of the retaining arms.

10. The archery apparatus of claim 9 wherein the bowstring release actuating means further includes a solenoid mounted on the body and connected to the plunger for moving the plunger and the cam away from the bowstring opening in response to an electrical solenoid actuating signal.

11. The archery apparatus of claim 10 further including a transmitter carried on the riser for generating a bowstring release signal and a receiver carried on the harness and connected to the solenoid for applying the solenoid actuating signal to the solenoid in response to the bowstring release signal.

12. The archery apparatus of claim 11 wherein the bowstring release signal is a light signal.

13. The archery apparatus of claim 9 wherein the cam of the bowstring release means includes a pair of substantially flat surfaces aligned parallel to the central plane for engaging the rollers on the second ends of the retaining arms in the bowstring retaining position.

14. The archery apparatus of claim 13 wherein the cam of the bowstring release means further includes a pair of concave surfaces joining the flat surfaces for receiving the rollers on the second ends of the retaining arms in the bowstring release position.

15. The archery apparatus of claim 1 further including an arrow rest mounted on the riser for supporting the shaft of an arrow on the shooting axis, the arrow rest having an upper shaft engaging surface and a lower end, means for pivotally mounting the lower end of the arrow rest to the riser and actuating means responsive to an electrical control signal for retracting the arrow rest away from the shooting axis when the bowstring is released to prevent the arrow rest from contacting the vanes on an arrow during its acceleration towards the target.

16. The archery apparatus of claim 15 wherein the arrow rest mounting means includes an arrow rest support member secured at one end to the riser and extending rearwardly toward the bowstring and a pin pivotally mounting the lower end of the arrow rest to the support member and wherein the arrow rest actuating means includes a solenoid responsive to the control signal and mounted on the support member, the solenoid having a plunger pivotally connected to the lower end of the arrow rest whereby movement of the plunger in one direction rotates the arrow rest to an upright position and movement of the plunger in the other direction rotates the arrow rest toward the riser.

17. The archery apparatus of claim 16 wherein the solenoid in response to the control signal moves the plunger in said other direction and wherein the actuating means further includes a spring connected between the plunger and the arrow rest support member for biasing the plunger in said one direction to maintain the arrow rest in the upright position in the absence of the application of the control signal to the solenoid.

18. The archery apparatus of claim 17 wherein the lower end of the arrow rest includes a pair of legs defining a generally U-shaped opening therebetween for accommodating the bowstring in its post release position.

19. The archery apparatus of claim 18 wherein the lower end of each leg of the arrow rest is pivotally mounted to the arrow rest support member.

20. The archery apparatus of claim 15 wherein the lower end of the arrow rest mounting means includes an arrow rest support member secured at one end to the riser and extending rearwardly toward the bowstring and a pin pivotally mounting the lower end of the arrow rest to the support member and wherein the arrow rest actuating means includes a spring for biasing the arrow rest toward the retracted position and a solenoid coupled to the lower end of the arrow rest for selectively maintaining the arrow rest in the upright position.

21. The archery apparatus of claim 15 wherein the actuating means for the arrow rest includes control signal generating means for generating the control signal in response to the release of the bowstring.

22. The archery apparatus of claim 21 wherein the control signal generating means is arranged to delay the generation of the control signal for a predetermined time delay from the release of the bowstring.

23. The archery apparatus of claim 15 wherein the bow is a compound bow with cables extending between the terminal ends of the bow limbs and wherein the actuating means for the arrow rest includes control signal generating means for generating the control signal in response to movement of the control cables.

24. A bowstring release mechanism for use with one or two-handed bow comprising:

a body defining an elongated opening with an entrance for receiving the bowstring, a pair of retaining arms, each arm having first and second ends, a roller mounted on the first end of each arm, the arms being pivoted on the body for movement between a bowstring retaining position in which the rollers mounted on the first ends block the entrance to bowstring receiving opening and engage the bowstring and a bowstring release position in which the rollers mounted on the first ends are removed from the entrance to release the bowstring, and actuating means for selectively applying a force to the second ends, of the retaining arms to pivot the arms so that the rollers mounted on the first ends thereof close the entrance to the bowstring opening and for selectively removing the force from the second ends of the retaining arms to allow the rollers mounted on the first ends of the retaining arms to pivot away from the entrance to the bowstring opening.

25. The bowstring release mechanism of claim 24 wherein the actuating means selectively forces the second ends of both arms outwardly away from the opening or allows the second ends of both arms to move inwardly toward the opening to cause the rollers mounted on the first ends to close and open the entrance to the bowstring opening, respectively.

26. The bowstring release mechanism of claim 25 further including a roller individually mounted on each of the first and second ends of each of the retaining arms.

27. The bowstring release mechanism of claim 26 wherein the actuating means comprises a cam positioned rearward of the bowstring opening and moveable parallel to the shooting axis of the bow for engaging the rollers mounted on the second ends of the retaining arms, a spring for biasing the cam toward the bowstring opening to force the rollers mounted on the second ends of the retaining arms outwardly in the bowstring retaining position and a plunger connected to the cam for moving the cam away from the bowstring opening to allow the rollers mounted on the second ends of the remaining arms to move inwardly to the bowstring release position.

28. The bowstring release mechanism of claim 27 wherein the actuating means further includes a solenoid mounted on the body and connected to the plunger for moving the plunger and the cam away from the bowstring opening in response to an electrical solenoid actuating signal.

29. The bowstring release mechanism of claim 28 further including a transmitter carried on the bow for generating a bowstring release signal and a receiver carried by the archer and connected to the solenoid for applying the solenoid actuating signal to the solenoid in response to the bowstring release signal.

30. The bowstring release mechanism of claim 29 wherein the bowstring release signal is a light signal.

31. The bowstring release mechanism of claim 27 wherein the cam includes a pair of substantially flat surfaces aligned parallel to the central plane for engaging the rollers on the second ends of the retaining arms in the bowstring retaining position.

32. The bowstring release mechanism of claim 31 wherein the cam further includes a pair of concave surfaces joining the flat surfaces for receiving the rollers on the second ends of the retaining arms in the bowstring release position.

33. In a retractable arrow rest for use with one or two-handed bows including a riser, a pair of resilient limbs having one end thereof secured to the riser and a free end remote from the riser and a bowstring connected between the free ends of the limbs and having a nocking point for engagement with the nock of an arrow, the bow being arranged to launch an arrow along a shooting axis upon release of the bowstring from its draw position, the combination comprising: an arrow rest bracket mounted on the an arrow rest bracket mounted on the riser for supporting the shaft of an arrow, the bracket having an upper shaft engaging surface and a lower end;

means for pivotally mounting the lower end of the bracket to the riser;

actuating means responsive to an electrical control signal for retracting the bracket away from the shooting axis; and means responsive to the release of the bowstring for generating the control signal.

34. The retractable arrow rest of claim 33 wherein the mounting means includes an arrow rest bracket support member secured at one end to the riser and extending rearwardly toward the bowstring and a pin pivotally mounting the lower end of the arrow rest bracket to the support member and wherein the actuating means includes a solenoid responsive to the control signal and mounted on the support member, the solenoid having a plunger pivotally connected to the lower end of the arrow rest bracket whereby movement of the plunger in one direction rotates the arrow rest bracket to an upright position and movement of the plunger in the other direction rotates the arrow rest bracket toward the riser.

35. The retractable arrow rest of claim 34 wherein the solenoid in response to the control signal moves the plunger in said other direction and wherein the actuating means further includes a spring connected between the plunger and the arrow rest bracket support member for biasing the plunger in said one direction to maintain the arrow rest bracket in the upright position in the absence of the application of the control signal to the solenoid.

36. The retractable arrow rest of claim 35 wherein the lower end of the arrow rest bracket includes a pair of legs defining a generally U-shaped opening therebetween for accommodating the bowstring in its post release position.

37. The retractable arrow rest of claim 36 wherein the lower end of each leg of the arrow rest bracket is pivotally mounted to the arrow rest bracket support member.

38. The retractable arrow rest of claim 33 wherein the lower end of the mounting means includes an arrow rest bracket support member secured at one end to the riser and extending rearwardly toward the bowstring and a pin pivotally mounting the lower end of the arrow rest bracket to the support member and wherein the actuating means includes a spring for biasing the arrow rest bracket toward the retracted position and a solenoid coupled to the lower end of the arrow rest bracket for selectively maintaining the arrow rest in the upright position.

39. The retractable arrow rest of claim 33 wherein the actuating means for the arrow rest bracket includes control signal generating means for generating the control signal in response to the release of the bowstring.

40. The retractable arrow rest of claim 39 wherein the control signal generating means is arranged to delay the generation of the control signal for a predetermined time delay from the release of the bowstring.

41. The retractable arrow rest of claim 40 wherein the bow is a compound bow with cables extending between the free ends of the bow limbs and wherein the actuating means includes control signal generating means for generating the control signal in response to movement of the control cables.

* * * * *

UNITED STATES PATENT AND TRADEMARK OFFICE

CERTIFICATE OF CORRECTION

PATENT NO. : 5,243,957

DATED : September 14, 1993

INVENTOR(S) : Gale W. Neilson

It is certified that error appears in the above-identified patent and that said Letters Patent is hereby corrected as shown below:

Column 1, line 22, "archer s" should read --archer's--.

Column 2, line 11, after "opening" should be --.--.

Column 2, line 34, after "bow" should be --equipped--.

Column 2, line 50, "FIG." should read --FIGS.--.

Column 4, line 32, after "arrow." and new paragraph should begin with "FIG.".

Column 11, line 29, "bow" should read --bows--.

Column 11, line 42, after "ends" delete --,--.

Column 12, line 38, delete "an arrow".

Column 12, line 39, delete "rest bracket mounted on the".

Signed and Sealed this

Fifth Day of April, 1994

Bruce Lehman

*Attest:*

BRUCE LEHMAN

*Attesting Officer*

*Commissioner of Patents and Trademarks*